US006196091B1

(12) United States Patent
Khokhar et al.

(10) Patent No.: US 6,196,091 B1
(45) Date of Patent: Mar. 6, 2001

(54) DRILL BIT FOR APPLYING TORQUE TO A FASTENER

(75) Inventors: Wasim Khokhar, Cordova, TN (US); Larry Burrough, Southaven, MS (US)

(73) Assignee: Thomas & Betts International, Sparks, NV (US)

( * ) Notice: Subject to any disclaimer, the term of this patent is extended or adjusted under 35 U.S.C. 154(b) by 0 days.

(21) Appl. No.: 09/271,140

(22) Filed: Mar. 17, 1999

(51) Int. Cl.[7] ..... B25B 23/00
(52) U.S. Cl. ..... 81/460; 81/467
(58) Field of Search ..... 81/13, 55, 125, 81/119, 176.1, 176.15, 176.2, 436, 460, 461, 467

(56) References Cited

U.S. PATENT DOCUMENTS 1,371,965 * 3/1921 York ..... 81/436
2,800,936 * 7/1957 West ..... 81/460
3,760,659 * 9/1973 Campbell ..... 81/176.15
3,985,170 * 10/1976 Iskra ..... 81/460
4,109,691 * 8/1978 Wilson ..... 81/119
5,403,130 4/1995 Moser et al. .
5,528,966 * 6/1996 Coppejans ..... 81/460
5,660,091 * 8/1997 Stone et al. ..... 81/460

* cited by examiner

*Primary Examiner*—David A. Scherbel
*Assistant Examiner*—Joni B. Danganan
(74) *Attorney, Agent, or Firm*—G. Andrew Barger

(57) ABSTRACT

A drill bit for applying torque to a fastener and mounting the fastener to a stud. The fastener has a plurality of support walls and a bore that has an axial length disposed within the fastener. The drill bit includes a shaft, which has an engagement end for abutting the stud. A member is attached to the shaft proximate the engagement end and has a plurality of arms each including a front side for biasing against one of the support walls when the drill bit is rotated. Moreover, when mounting of the fastener on the stud is initiated, the fastener is rotated by the front side of each of the plurality of arms of the member biasing against one of the support walls of the fastener, subsequently, the engagement end of the shaft abuts the stud and is prevented from biasing axially while simultaneously the fastener continues to be progressively mounted on the stud.

17 Claims, 4 Drawing Sheets

DRILL BIT FOR APPLYING TORQUE TO A FASTENER

FIELD OF THE INVENTION

In general, the present invention relates to drill bits and, in particular, the present invention relates to a drill bit for precisely applying torque to a fastener.

BACKGROUND

Stud mounted fasteners have existed for a number of years. One of their many uses is to mount the fasteners in a given area such that wires can be coupled thereto on extensions of the fasteners, typically via cable ties, and rerouted. The installation of these fasteners, however, has become difficult and commonly results in the extensions of the fastener being broken as a result of their use in applying torque to the fastener. What's more, torque is often over-applied to these fasteners causing them to be "stripped" and unuseable.

SUMMARY OF THE INVENTION

The present invention eliminates the above difficulties and disadvantages by providing a drill bit for applying torque to a fastener and mounting the fastener to a threaded stud. The fastener has a plurality of support walls and a bore disposed within the fastener. The drill bit has a shaft including a hexagonal end and an engagement end integrally formed with the hexagonal end for abutting the stud. A cross-shaped member is integrally formed with the shaft and positioned between the hexagonal end and the engagement end.

The cross-shaped member has a plurality of arms each including a front side and a ramp coupled to the front side for biasing against one of the support walls when the fastener is torqued such that the fastener is mounted onto the threaded stud. When mounting of the fastener on the stud is initiated, the fastener is rotated by the front side of each of the plurality of arms of the cross-shaped member biasing against one of the support walls of the fastener.

Subsequently, the engagement end of the shaft abuts the stud and is prevented from biasing axially. Simultaneously, the fastener continues to be progressively mounted on the stud as the fastener transitions from being rotated by the front side of each of the plurality of arms of the cross-shaped member biasing against one of the support walls of the fastener, to the ramp biasing against one of the support walls thereby limiting torque applied to the fastener via the drill bit and separating the fastener from the drill bit when the engagement member abuts the stud.

DETAILED DESCRIPTION OF THE PREFERRED EMBODIMENT(S)

Figure 1:
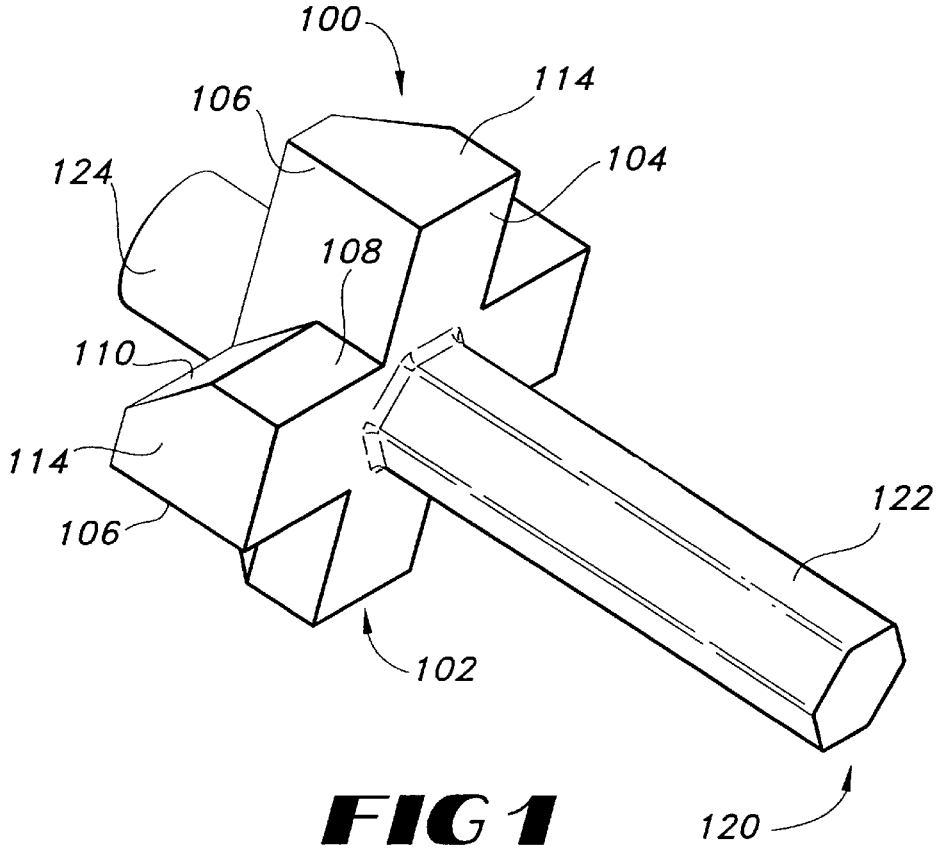
FIG. 1 is a perspective view of a drill bit of the present invention.
Figure 3:
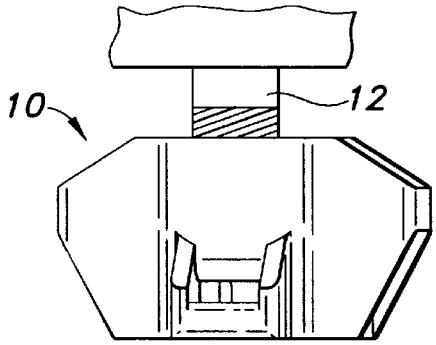
FIG 3 PRIOR ART
FIG. 3 is a perspective view of the fastener mounted on a threaded stud.
Figure 8:
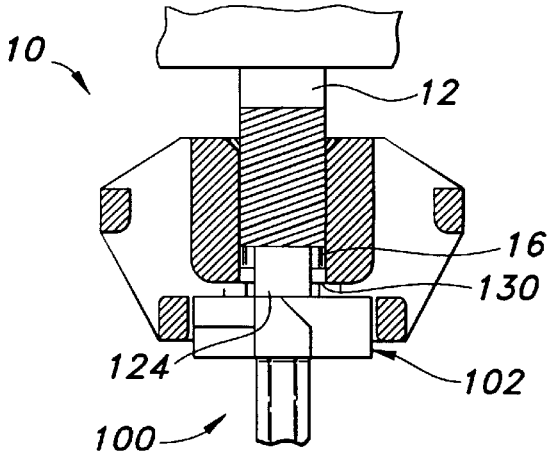
FIG. 8 is a cross-sectional view of the fastener taken along sight line A—A of FIG. 7 and further including a cross-sectional view of the drill bit of the present invention.

The above and other features, aspects, and advantages of the present invention will now be discussed in the following detailed description and appended claims, which are to be considered in conjunction with the accompanying drawings in which identical reference characters designate like elements throughout the views. Shown in FIG. 1 is a drill bit 100 for applying torque to a fastener and mounting the fastener 10 to a threaded stud 12, which is shown in FIGS. 3 and 8.

Shown in FIGS. 2, 3, 7–10, is a stud mounted fastener 10 for routing a plurality of wires in a plurality of directions at the fastener 10 and securing at least one of the plurality of wires to the fastener 10 via at least one cable tie. The stud mounted fastener 10 is preferably manufactured by the Thomas & Betts Corporation having a principal place of business at 8155 T&B Boulevard, Memphis, Tenn. 38125 and a URL, at www.tnb.com. It is understood, however, that any number of fasteners meeting the requirements as set forth below in relation to the support walls 118 and bore 130 could be employed with the present invention. The fastener 10 is also preferably constructed of nylon, but could be constructed of any thermo-plastic that is relatively hard and durable.

The fastener 10 includes an abutment member 18 for mounting on the stud 12, the abutment member 18 has a bore 130 formed therein and a plurality of tangs 16 radially surrounding and axially extending from the bore 130, which has an axial length. During installation, when the fastener 10 is mounted on the stud 12, as shown in FIG. 8, the plurality of tangs 16 arc penetrated by the threads of the stud 12. Once installed, the wires can be routed in a plurality of directions at the fastener 10 and fastened thereto via cable ties.

Figure 4:
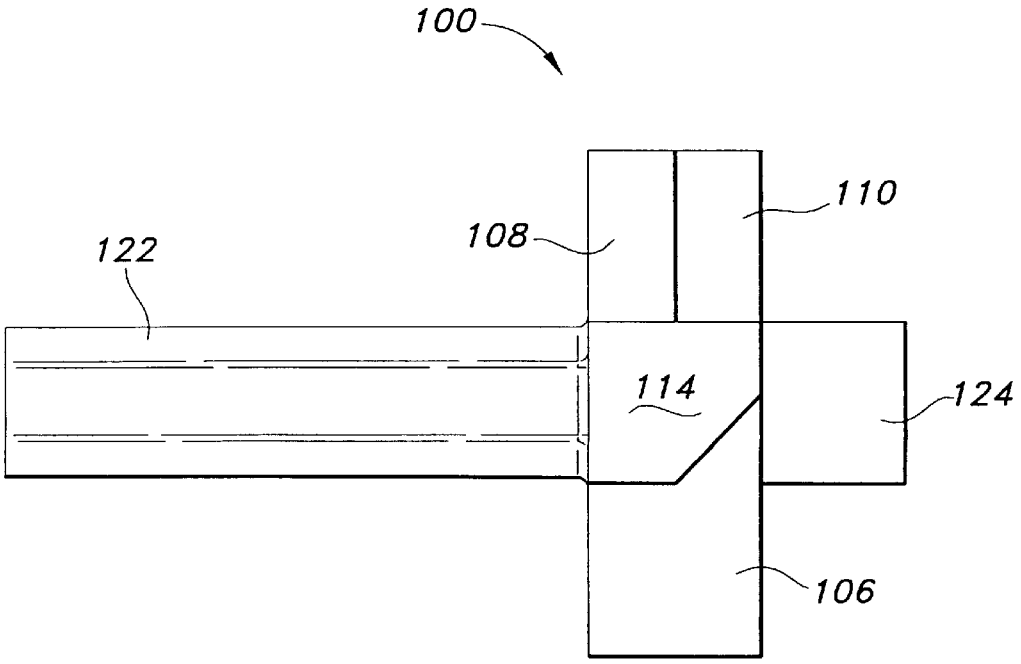
FIG. 4 is a side elevational view of the drill bit of the present invention.
Figure 2:
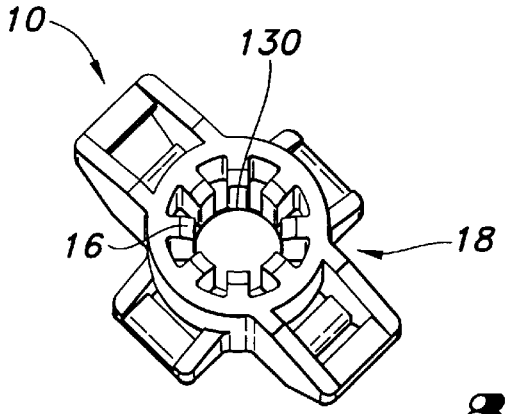
FIG 2 PRIOR ART
FIG. 2 is a perspective view of a fastener.
Figure 7:
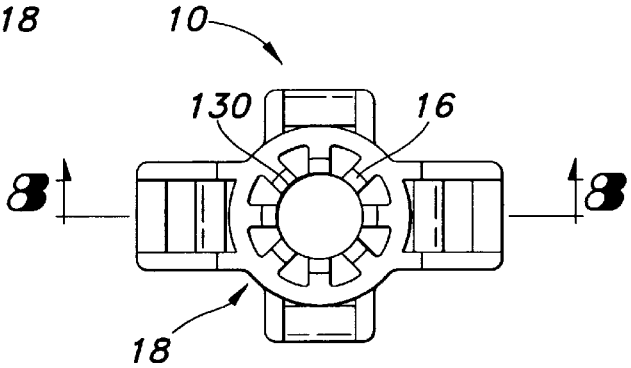
FIG 7 PRIOR ART
FIG. 7 is a plan view of the fastener.
Figure 9:
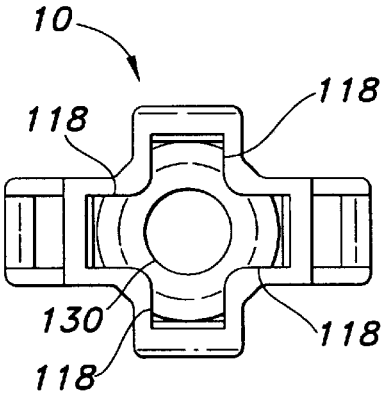
FIG 9 PRIOR ART
FIG. 9 is a another plan view of the fastener from the opposite end.
Figure 5:
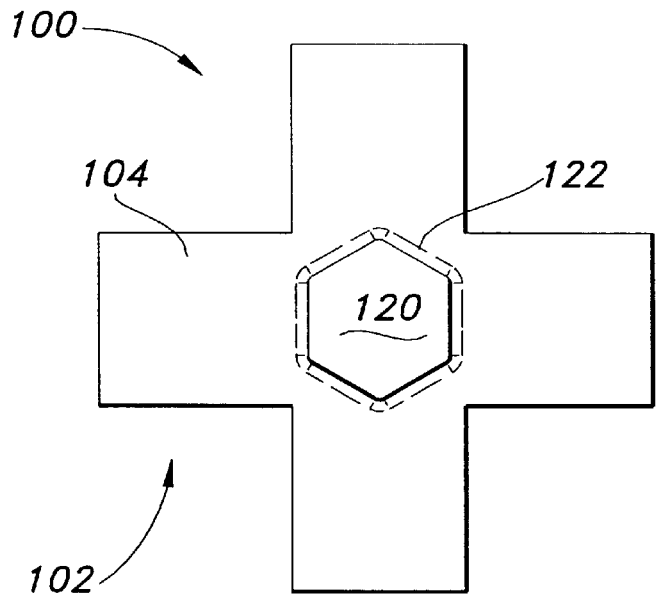
FIG. 5 is a first end plan view of the drill bit of the present invention.
Figure 6:
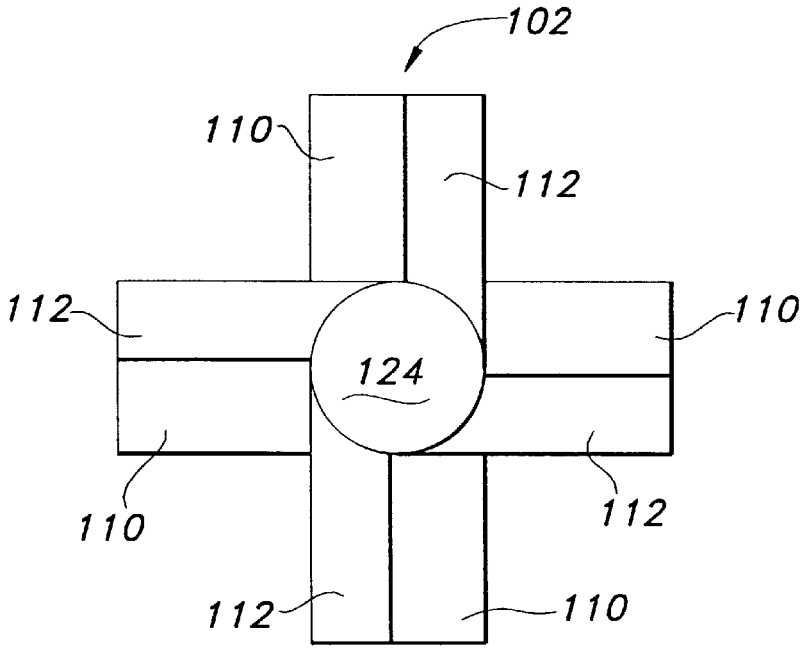
FIG. 6 is a second end plan view of the drill bit of the present invention.

The fastener 10 has a plurality of support walls 118, as shown in FIG. 9, and as will be discussed below. The drill bit 100 has a shaft 120 including a hexagonal end 122, as is best shown in FIGS. 1, 4, and 5, and an engagement end 124, as is best shown in FIGS. 1, 4, and 6, integrally formed with the hexagonal end 122 for abutting the stud 12. In operation, the hexagonal end 122 is preferably coupled to a drill for imparting torque to the drill bit 100. A cross-shaped member 102 is integrally formed with the shaft 120 and positioned between the hexagonal end 122 and the engagement end 124, which has a first set length. Preferably, the cross-shaped member 102 is integrally formed between the hexagonal end 122 and the engagement end 124 but could also be welded.

As shown in FIGS. 1 and 6, the cross-shaped member 102 has a plurality of arms 104 each including a front side 108, and a ramp 110 coupled to the front side 108 that its function will be discussed in greater detail below. The front side 108 has a second set length, the purpose of which will also be described below. The ramp 110 is disposed between the front side 108 and an abutment side 112. Disposed opposite the front side 108 is a back side 106. The abutment side 112, front side 108, ramp 110, periphery side 114, and back side 106 of each arm are integrally formed.

Figure 10:
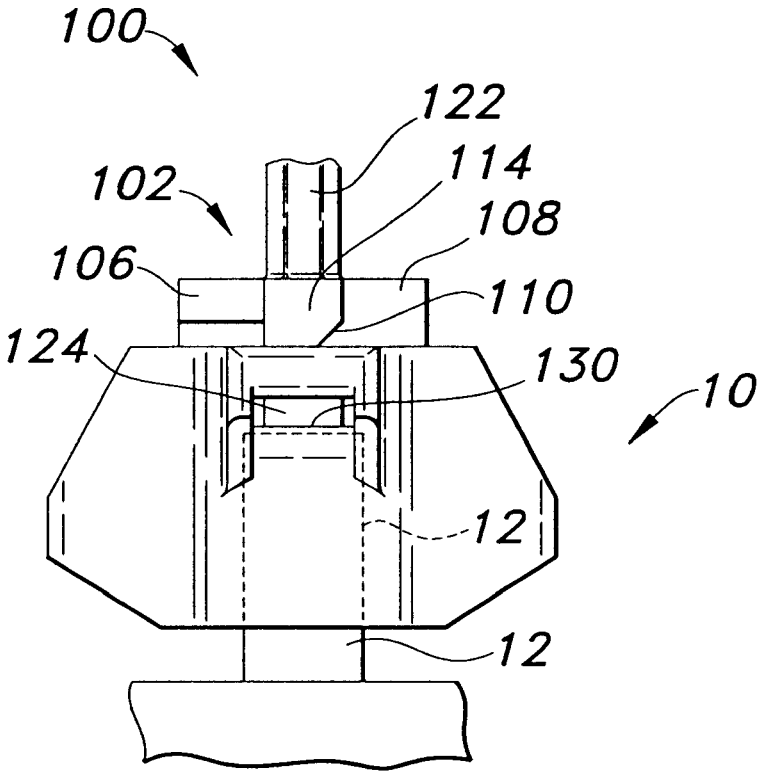
FIG. 10 is a side elevational view of the drill bit of the present invention abutting the threaded stud as the fastener is mounted on the stud.

When mounting of the fastener 10 on the stud 12 is initiated, as shown in FIG. 3, the fastener 10 is rotated by the front side 108 of each of the plurality of arms 104 of the cross-shaped member 102 biasing against corresponding support walls 118 of the fastener 10. Subsequently, the engagement end 124 of the shaft 120 abuts the stud 12 and is prevented from biasing axially, as shown in FIG. 8. While simultaneously, the fastener 10 continues to be progressively mounted on the stud 12 as the fastener 10 transitions from being rotated by the front side 108 of each of the plurality of arms 104 of the cross-shaped member 102 biasing against one of the support walls 118 of the fastener 10, to the ramp 110 biasing against one of the support walls 118, as shown in FIG. 10.

Therefore, torque application to the fastener 10 via the drill bit 100 is limited via the ramps 10, which further separate the fastener 10 from the drill bit 100 when the engagement end 124 abuts the stud 12. The ramp 110 is preferably sloped at a forty-five degree angle, but could be also be sloped at other angles depending upon the particular fastener being installed and the angle of the support walls 118. Optimally, the first set length of the engagement end 124 equals the sum of the axial length of the bore 130 and the second set length of the front side 108 thereby precisely limiting torque applied to the fastener 10 via the drill bit 100 and separating the fastener 10 from the drill bit 100 when the engagement end 124 abuts the stud 12.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A drill bit for applying torque to a fastener and mounting the fastener to a stud, the fastener having a plurality of support walls and a bore having an axial length disposed within the fastener, the drill bit comprising:

a shaft having an engagement end for abutting the stud, the engagement end having a first set length;

a member attached to the shaft proximate the engagement end and having a plurality of arms each including a front side for biasing against one of the support walls when the drill bit is rotated, the front side having a second set length;

a ramp, sloped at a forty-five degree angle coupled to the front side of each of the plurality of arms; and wherein when mounting of the fastener on the stud is initiated, the fastener is rotated by the front side of each of the plurality of arms of the member biasing against one of the support walls of the fastener, subsequently, the engagement end of the shaft abuts the stud and is prevented from biasing axially while simultaneously the fastener continues to be progressively mounted on the stud.

2. The drill bit of claim 1 wherein when the engagement end of the shaft abuts the stud, the fastener transitions from being rotated by the front side of each of the plurality of arms of the member biasing against one of the support walls, to the ramp of each of the plurality of arms biasing against one of the support walls thereby limiting torque applied to the fastener via the drill bit and separating the fastener from the drill bit.

3. The drill bit of claim 1 wherein the member is cross-shaped.

4. The drill bit of claim 1 wherein the shaft further includes a hexagonal end.

5. The drill bit of claim 4 wherein the member is positioned between the hexagonal end and the engagement end.

6. The drill bit of claim 4 wherein the engagement end is integrally formed with the hexagonal end.

7. The drill bit of claim 1 wherein the first set length of the engagement end equals the sum of the axial length of the bore and the second set length of the front side thereby limiting torque applied to the fastener via the drill bit and separating the fastener from the drill bit when the engagement member abuts the stud.

8. A drill bit for applying torque to a fastener and mounting the fastener to a stud, the fastener having a plurality of support walls and a bore having an axial length disposed within the fastener, the drill bit comprising:

a shaft having an engagement end for abutting the stud, the engagement end having a first set length;

a member attached to the shaft proximate the engagement end and having a plurality of arms each including a front side for biasing against one of the support walls when the drill bit is rotated, the front side having a second set length; and wherein the first set length of the engagement end equals the sum of the axial length of the bore and the second set length of the front side thereby limiting torque applied to the fastener via the drill bit and separating the fastener from the drill bit when the engagement member abuts the stud.

9. The drill bit of claim 8 wherein when mounting of the fastener on the stud is initiated, the fastener is rotated by the front side of each of thc plurality of arms of the member biasing against one of the support walls of the fastener, subsequently, the engagement end of the shaft abuts the stud and is prevented from biasing axially while simultaneously the fastener continues to be progressively mounted on the stud.

10. The drill bit of claim 9 further including a ramp coupled to the front side of each of the plurality of arms.

11. The drill bit of claim 10 wherein when the engagement end of the shaft abuts the stud, the fastener transitions from being rotated by the front side of each of the plurality of arms of the member biasing against one of the support walls, to the ramp of a each of the plurality of arms biasing against one of the support walls thereby further limiting torque applied to the fastener via the drill bit and further separating the fastener from the drill bit when the engagement member abuts the stud.

12. The drill bit of claim 10 wherein the ramp is sloped at a forty-five degree angle.

13. The drill bit of claim 8 wherein the member is cross-shaped.

14. The drill bit of claim 8 wherein the shaft further includes a hexagonal end.

15. The drill bit of claim 14 wherein the member is positioned between the hexagonal end and the engagement end.

16. The drill bit of claim 14 wherein the engagement end is integrally formed with the hexagonal end.

17. A drill bit for applying torque to a fastener and mounting the fastener to a threaded stud, the fastener having a plurality of support walls, a bore disposed within the fastener, and a plurality of tangs radially surrounding and axially extending from the bore, the drill bit comprising:

a shaft including a hexagonal end and an engagement end integrally formed with the hexagonal end for abutting the stud;

a cross-shaped member integrally formed with the shaft and positioned between the hexagonal end and the engagement end, the cross-shaped member having a plurality of arms each including:

a front side, and a ramp, shaped at forty five degrees, coupled to the front side for biasing against one of the support walls when the fastener is torqued such that the fastener is mounted onto the threaded stud; and wherein when mounting of the fastener on the stud is initiated, the fastener is rotated by the front side of each of the plurality of arms of the cross-shaped member biasing against one of the support walls of the fastener, subsequently, the engagement end of the shaft abuts the stud and is prevented from biasing axially while simultaneously the fastener continues to be progressively mounted on the stud as the fastener transitions from being rotated by the front side of each of the plurality of arms of the cross-shaped member biasing against one of the support walls of the fastener, to the ramp biasing against one of the support walls thereby limiting torque applied to the fastener via the drill bit and separating the fastener from the drill bit when the engagement member abuts the stud.

* * * * *